US012534332B1

(12) United States Patent
McDowell

(10) Patent No.: US 12,534,332 B1
(45) Date of Patent: Jan. 27, 2026

(54) LAYOUT LINE SPOOLING DEVICE

(71) Applicant: Robert McDowell, Fremont, IN (US)

(72) Inventor: Robert McDowell, Fremont, IN (US)

( * ) Notice: Subject to any disclaimer, the term of this patent is extended or adjusted under 35 U.S.C. 154(b) by 73 days.

(21) Appl. No.: 18/630,097

(22) Filed: Apr. 9, 2024

(51) Int. Cl.
*B65H 75/40* (2006.01)
*B65H 75/30* (2006.01)

(52) U.S. Cl.
CPC ..... *B65H 75/406* (2013.01); *B65H 75/305* (2013.01)

(58) Field of Classification Search
CPC ..... B65H 75/40; B65H 75/305; B65H 75/406
See application file for complete search history.

(56) References Cited

U.S. PATENT DOCUMENTS 4,728,048 A 3/1988 Batson
D326,048 S 5/1992 Adler
5,277,350 A 1/1994 Thornbury, Jr.
6,398,147 B1 6/2002 Fredrickson
6,648,262 B1 11/2003 Huffman
8,827,198 B1 * 9/2014 Steadman, Sr. ..... B65H 75/305 242/613.2
11,120,374 B2 9/2021 Jaramillo
2009/0236459 A1 9/2009 McMann
2018/0346280 A1 * 12/2018 Franck ..... B65H 75/305

* cited by examiner

*Primary Examiner* — Sang K Kim
(74) *Attorney, Agent, or Firm* — Kyle A. Fletcher, Esq.

(57) ABSTRACT

The layout line spooling device forms the working element of a tool. The layout line spooling device is configured for use with a drill. The layout line spooling device attaches to the drill to form the working element of the drill. The layout line spooling device is configured for use with a cord. The layout line spooling device forms a spool that takes up the cord for storage. The layout line spooling device incorporates a handle structure, a mounting bushing, and a spool structure. The mounting bushing attaches the spool structure to the handle structure. The drill attaches to the spool structure. The rotation of the drill provides the motive forces that winds the cord onto the spool structure for storage.

12 Claims, 4 Drawing Sheets

LAYOUT LINE SPOOLING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of devices for transferring line to a reel. (A01K89/003)

SUMMARY OF INVENTION

The layout line spooling device forms the working element of a tool. The layout line spooling device is configured for use with a drill. The layout line spooling device attaches to the drill to form the working element of the drill. The layout line spooling device is configured for use with a cord. The layout line spooling device forms a spool that takes up the cord for storage. The layout line spooling device comprises a handle structure, a mounting bushing, and a spool structure. The mounting bushing attaches the spool structure to the handle structure. The drill attaches to the spool structure. The rotation of the drill provides the motive forces that winds the cord onto the spool structure for storage.

These together with additional objects, features and advantages of the layout line spooling device will be readily apparent to those of ordinary skill in the art upon reading the following detailed description of the presently preferred, but nonetheless illustrative, embodiments when taken in conjunction with the accompanying drawings.

In this respect, before explaining the current embodiments of the layout line spooling device in detail, it is to be understood that the layout line spooling device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the layout line spooling device.

It is therefore important that the claims be regarded as including such equivalent construction insofar as they do not depart from the spirit and scope of the layout line spooling device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
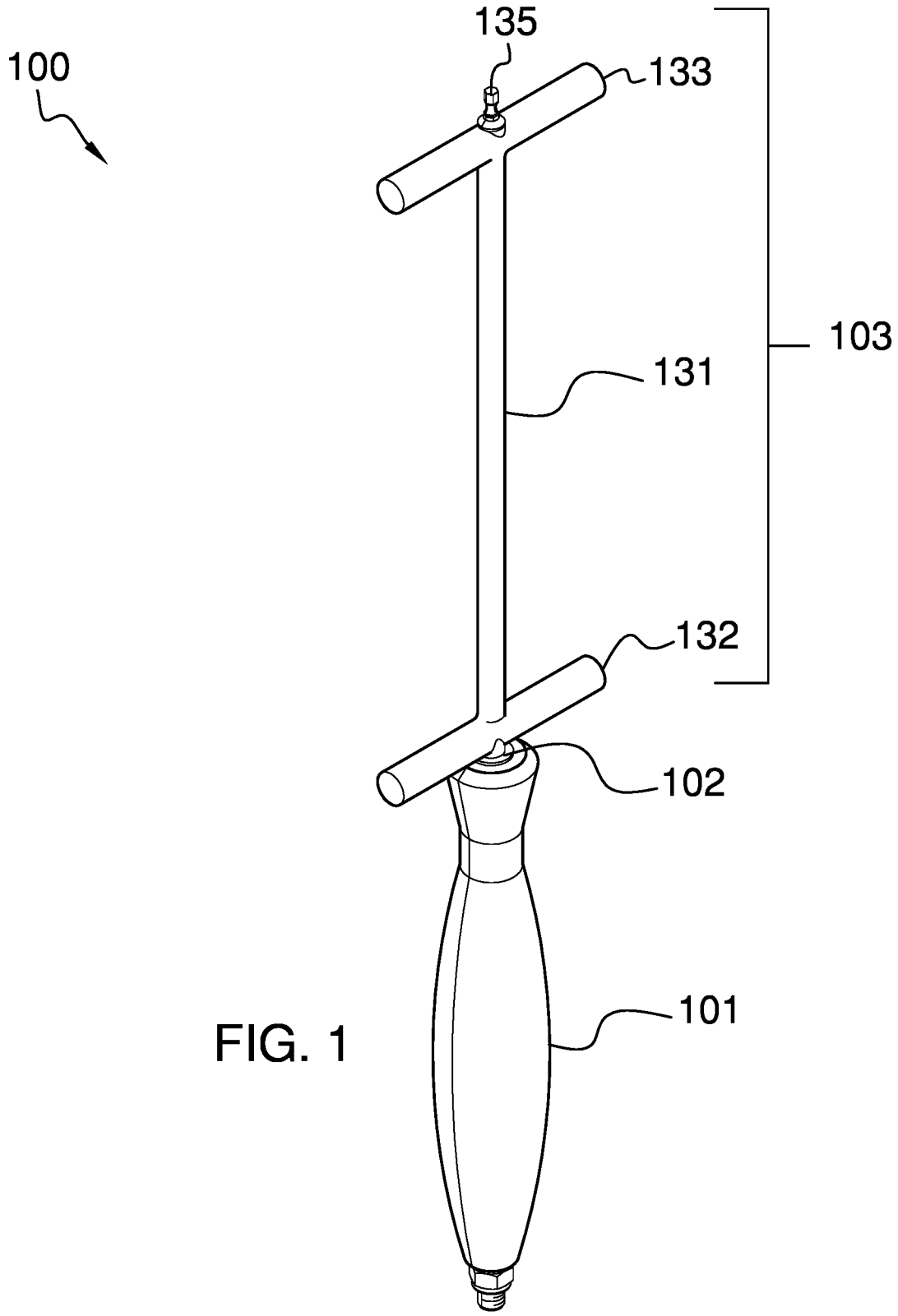
FIG. 1 is a perspective view of an embodiment of the disclosure.
Figure 2:
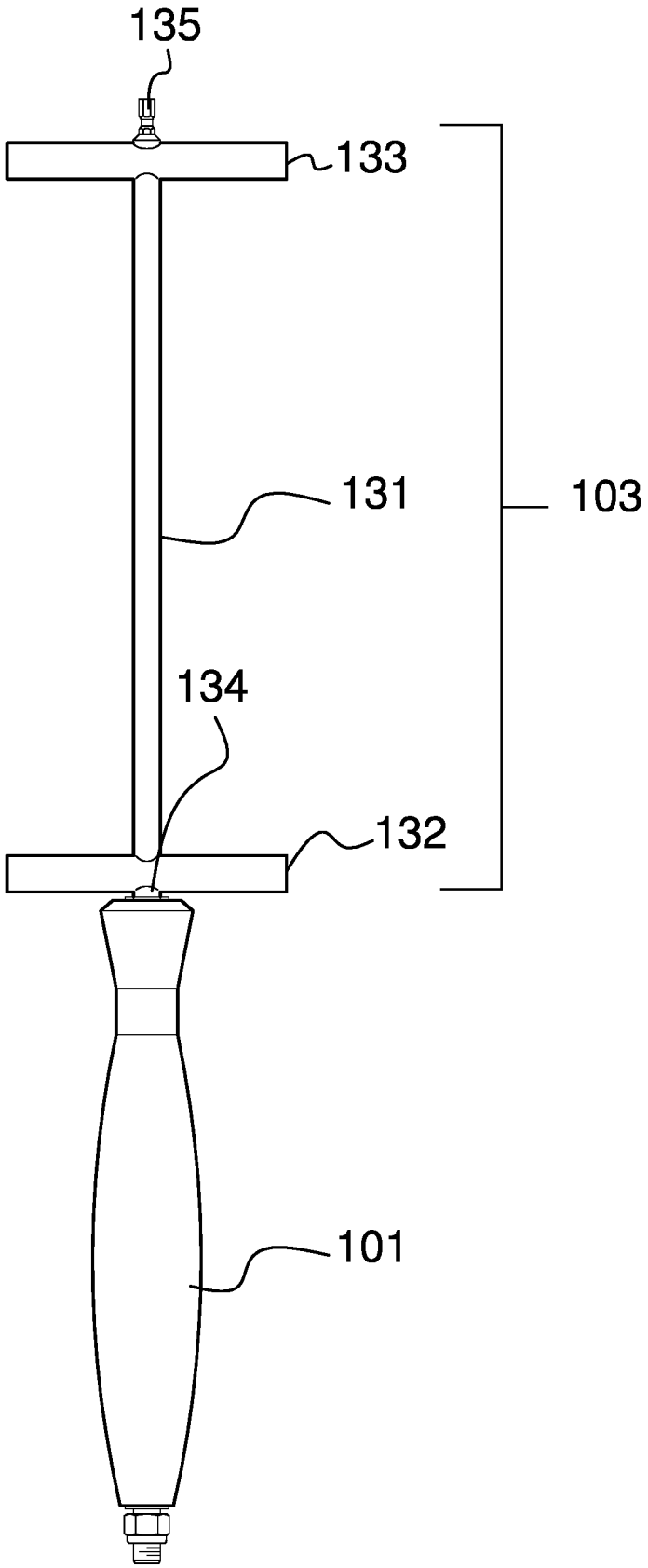
FIG. 2 is a front view of an embodiment of the disclosure.
Figure 3:
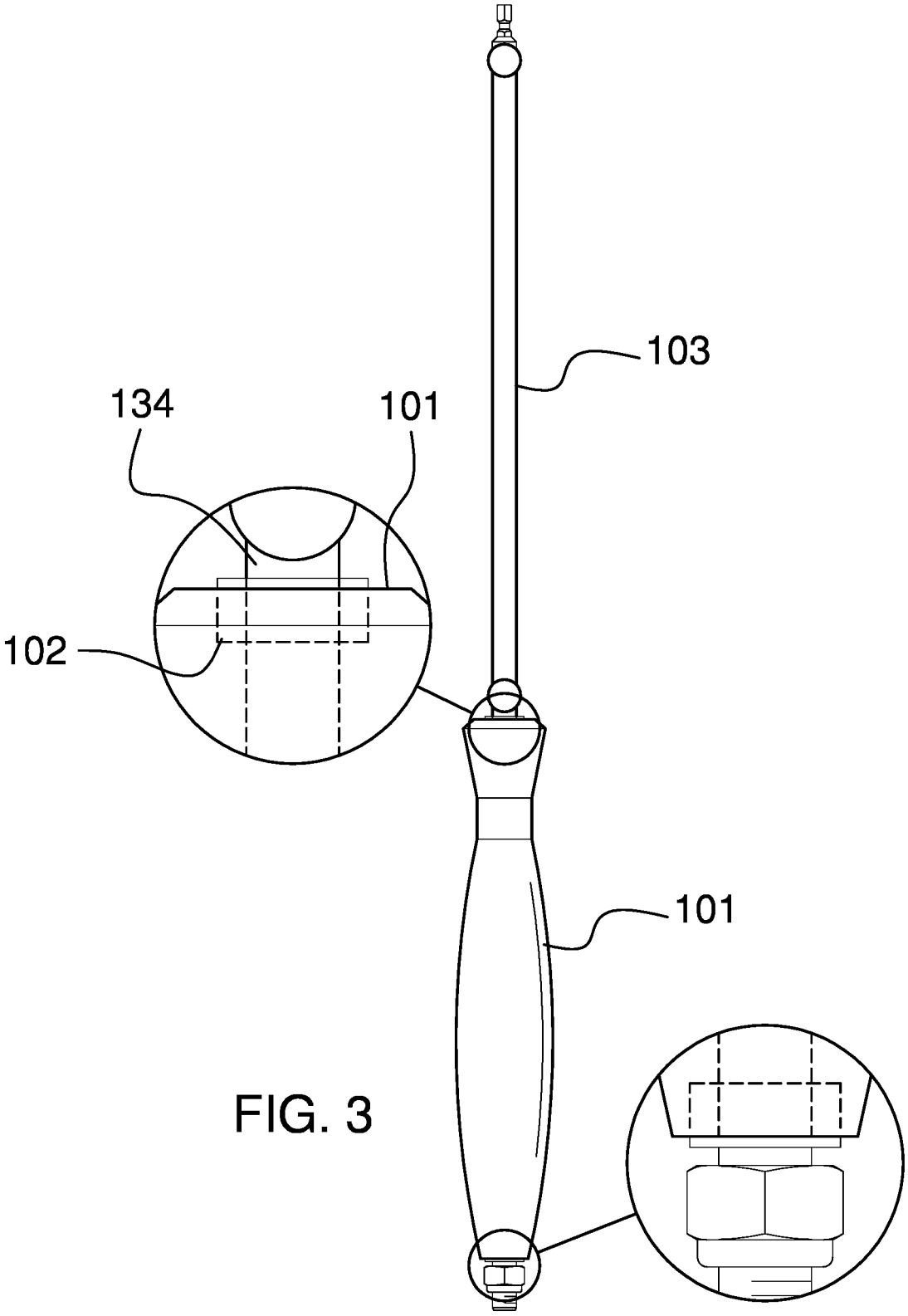
FIG. 3 is a side view of an embodiment of the disclosure.
Figure 4:
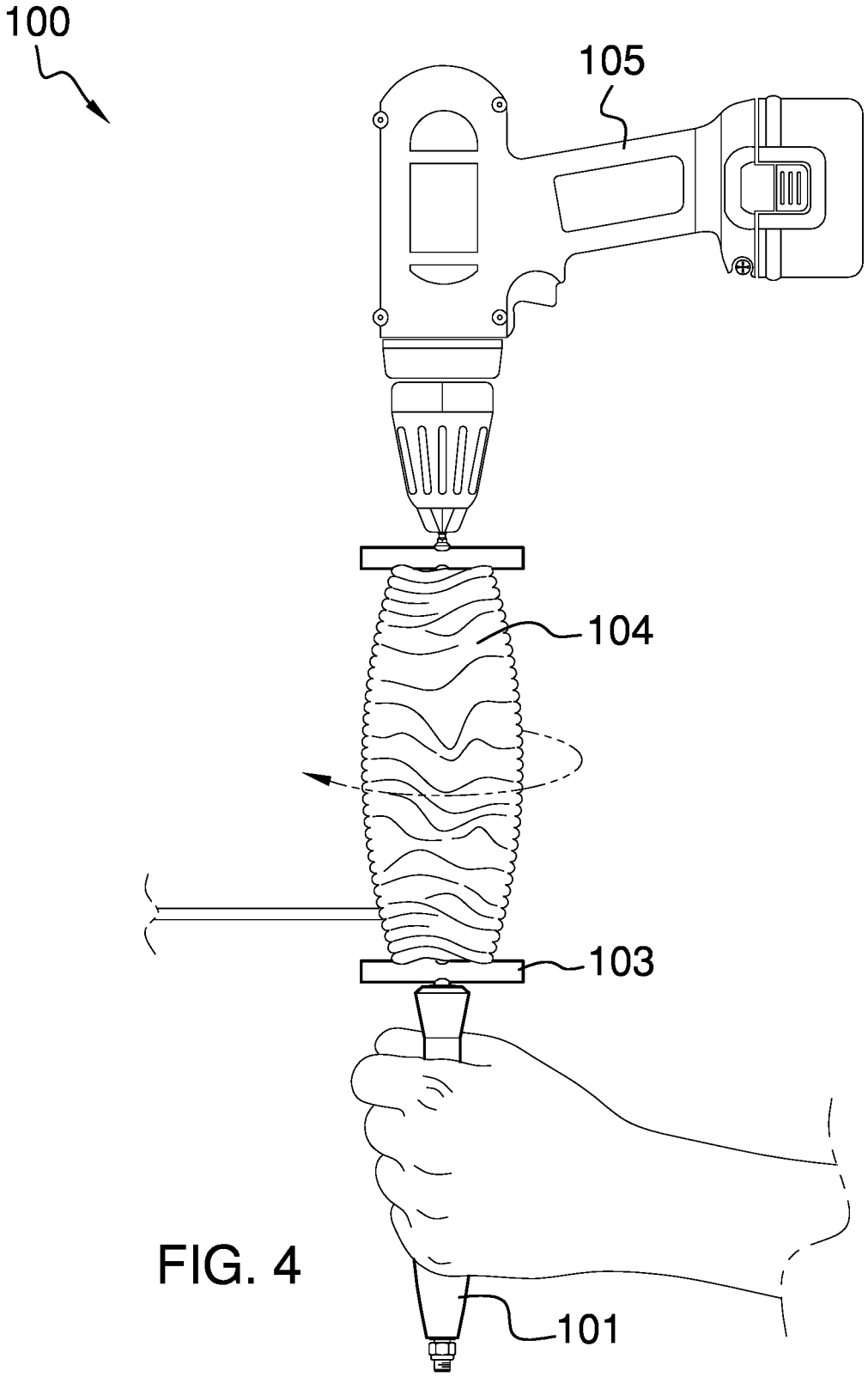
FIG. 4 is an in-use view of an embodiment of the disclosure.

Detailed reference will now be made to one or more potential embodiments of the disclosure, which are illustrated in FIGS. 1 through 4.

The layout line spooling device 100 (hereinafter invention) forms the working element of a tool. The invention 100 is configured for use with a drill 105. The invention 100 attaches to the drill 105 to form the working element of the drill 105. The invention 100 is configured for use with a cord 104. The invention 100 forms a spool that takes up the cord 104 for storage. The invention 100 comprises a handle structure 101, a mounting bushing 102, and a spool structure 103. The mounting bushing 102 attaches the spool structure 103 to the handle structure 101. The drill 105 attaches to the spool structure 103. The rotation of the drill 105 provides the motive forces that winds the cord 104 onto the spool structure 103 for storage.

The cord 104 is a flexible structure. The cord 104 is a prism shaped structure. The cord 104 presents a resistance to a tensile force. The cord 104 does not present a resistance to a compressive force.

The drill 105 is a hand tool. The drill 105 is a power tool. The drill 105 forms a mechanical linkage with the spool structure 103. The drill 105 generates a rotational force that is transferred to the spool structure 103 through the mechanical linkage.

The handle structure 101 is a roughly prism shaped structure. The handle structure 101 is a rigid structure. The handle structure 101 forms a grip that is used to carry the invention 100.

The mounting bushing 102 is a rolling element bearing. The mounting bushing 102 mounts on a congruent end of the handle structure 101. The mounting bushing 102 attaches to the handle structure 101 such that the axis of rotation of the mounting bushing 102 aligns with the center axis of the handle structure 101. The mounting bushing 102 forms a rotating structure. The mounting bushing 102 secures the spool structure 103 to the handle structure 101 such that the spool structure 103 rotates freely relative to the handle structure 101.

The spool structure 103 is a spool. The spool structure 103 forms the structure that stores the cord 104. The spool structure 103 rotates relative to the handle structure 101. The spool structure 103 rotates in a first direction to deploy the cord 104 from the spool structure 103. The spool structure 103 rotates in a second direction to retract the cord 104 on to the spool structure 103. The second direction is opposite to the first direction. The spool structure 103 forms a mechanical linkage with the drill 105. The drill 105 provides the spool structure 103 with the rotational force necessary to retract the cord 104 on to the spool structure 103. The spool structure 103 comprises a core shaft structure 131, a handle flange structure 132, and a distal flange structure 133.

The core shaft structure 131 is a prism shaped structure. The core shaft structure 131 is a rigid structure. The core shaft structure 131 is an extension structure. The core shaft structure 131 forms the reach between the handle flange structure 132 and the distal flange structure 133. The core shaft structure 131 attaches the spool structure 103 to the mounting bushing 102 such that the mounting bushing 102 rotates the spool structure 103. The core shaft structure 131 attaches to the mounting bushing 102 such that the center of axis of the core shaft structure 131 aligns with the axis of rotation of the mounting bushing 102.

The lateral face of the core shaft structure 131 forms the surface on which the cord 104 is stored. The cord 104 wraps around the lateral face of the core shaft structure 131 for storage. The drill 105 transmits the rotational force to the core shaft structure 131 that is necessary to wrap the cord 104 around the lateral face of the core shaft structure 131.

The handle flange structure 132 is a prism shaped structure. The handle flange structure 132 is a rigid structure. The handle flange structure 132 forms a stop that prevents the cord 104 from slipping off the lateral face of the core shaft structure 131. The handle flange structure 132 attaches to the congruent end of the core shaft structure 131 that is proximal to the handle structure 101. The handle flange structure 132 attaches to the core shaft structure 131 such that the center axis of the handle flange structure 132 is perpendicular to the center axis of the core shaft structure 131. The handle flange structure 132 attaches to the core shaft structure 131 such that the center axis of the core shaft structure 131 intersects with the center point of the center axis of the handle flange structure 132.

The distal flange structure 133. The distal flange structure 133 is a prism shaped structure. The distal flange structure 133 is a rigid structure. The distal flange structure 133 forms a stop that prevents the cord 104 from slipping off the lateral face of the core shaft structure 131. The distal flange structure 133 attaches to the congruent end of the core shaft structure 131 that is proximal to the drill 105. The distal flange structure 133 attaches to the core shaft structure 131 such that the center axis of the distal flange structure 133 is perpendicular to the center axis of the core shaft structure 131. The distal flange structure 133 attaches to the core shaft structure 131 such that the center axis of the core shaft structure 131 intersects with the center point of the center axis of the distal flange structure 133.

The handle flange structure 132 further comprises a mounting bushing 102 mount 134. The mounting bushing 102 mount 134 is a mechanical structure. The mounting bushing 102 mount 134 mounts on the lateral face of the handle flange structure 132 such that the center of the mounting bushing 102 mount 134 aligns with the center axis of the core shaft structure 131. The mounting bushing 102 mount 134 forms the structure of the spool structure 103 that secures the spool structure 103 to the mounting bushing 102.

The distal flange structure 133 further comprises a drill 105 bit 135. The drill 105 bit 135 is a bit. The drill 105 bit 135 forms the mechanical structure that attaches the spool structure 103 to the drill 105. The drill 105 bit 135 attaches to the drill 105 such that the rotation of the drill 105 rotates the drill 105 bit 135. The drill 105 bit 135 mounts on the lateral face of the distal flange structure 133 such that the axis of rotation of the drill 105 bit 135 aligns with the center axis of the core shaft structure 131. The drill 105 bit 135 transfers the rotational force generated by the drill 105 to the balance of the mounting bushing 102.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bearing: As used in this disclosure, a bearing is a mechanical device that: 1) guides and limits the motion of a moving component relative to a fixed component; and, 2) reduces the friction between the moving component and the fixed component. A locking bearing is a bearing that can be locked such that the rotation or movements are secured into a fixed position until the locking bearing is subsequently unlocked.

Bit: As used in this disclosure, a bit is the device that attaches a working element to a rotating tool. Bits are often interchangeable in a base tool. A bit typically has a prism shape. Examples of the use of a bit include, but are not limited to, boring holes or driving screws. Bits are often formed with a magnetic material.

Bushing: As used in this disclosure, a bushing is a cylindrical aperture through which an object is guided and potentially secured. Bushings are often used as protective linings.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Chuck: As used in this disclosure, a chuck is a structure that attaches a bit or a working element to a tool. The part of the chuck that opens and closes to capture the bit is called the jaw.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drill: As used in this disclosure, a drill is a mechanical device used to rotate a bit. The bit is secured to the drill using a chuck. The drill is a tool. The bit is an interchangeable structure that attaches a working element to the drill. Drills are often powered using an electric motor.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Hand Tool: As used in this disclosure, a hand tool refers to a tool that is small and light enough to allow a person to hold the tool during use.

Handle: As used in this disclosure, a handle is an object by which a tool, object, or door is held or manipulated with the hand.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Power Tool: As used in this disclosure, a power tool is a mechanical device that is operated by a source of energy other than physical work done by a person or animal.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reach: As used in this disclosure, reach refers to a span of distance between any two objects.

Rigid Structure: As used in this disclosure, a rigid structure is a solid structure formed from an inelastic material that resists changes in shape. A rigid structure will permanently deform as it fails under a force. See bimodal flexible structure.

Rolling Element Bearing: As used in this disclosure, a rolling element bearing comprises is a type of bearing comprising an inner race, and outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object and the outer race attaches to a second object such that the first object rotates relative to the second object. Typically, a rolling element bearing is disk shaped. A rolling element bearing is said to be "locking" when the relative position of the inner race is locked into a fixed position relative to the outer race.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Stop: As used in this disclosure, a stop is a mechanical structure that blocks the motion of an object along a track. The stop is used to limit the range of motion of the object.

Tool: As used in this disclosure, a tool is a device, an apparatus, or an instrument that is used to carry out an activity, operation, or procedure. A tool generally comprises a working element and a handle. The handle of a tool that forms a sub-component of a larger structure is referred to as a mount.

Twist, Wrap, and Bend: As used in this disclosure, the terms twist, wrap, and bend are used to describe methods to deform a prism structure. A prism structure is said to bend when the deforming force deforms the center axis into a non-Euclidean line. A prism structure is said to twisted when the axis of rotation of a deforming force aligns with the center axis of the prism structure. Two prism structures are said to wrap when: a) the two prism structure combine to form a lateral prism structure; and, b) the center axis of at least one of the two prism structures forms a helical structure.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A layout line spooling device comprising
a handle structure, a mounting bushing, and a spool structure;
wherein the mounting bushing attaches the spool structure to the handle structure;
wherein the layout line spooling device is configured for use with a drill;
wherein the layout line spooling device is configured for use with a cord;
wherein the rotation of the drill provides the motive force that winds the cord onto the spool structure for storage;
wherein the spool structure comprises a core shaft structure, a handle flange structure, and a distal flange structure;
wherein the handle flange structure attaches to the core shaft structure;
wherein the distal flange structure attaches to the core shaft structure;
wherein the core shaft structure attaches the spool structure to the mounting bushing such that the mounting bushing rotates the spool structure;
wherein the core shaft structure attaches to the mounting bushing such that a center of axis of the core shaft structure aligns with an axis of rotation of the mounting bushing;
wherein a lateral face of the core shaft structure forms the surface on which the cord is stored;
wherein the cord wraps around the lateral face of the core shaft structure for storage.

2. The layout line spooling device according to claim 1
wherein the layout line spooling device forms the working element of a tool;
wherein the layout line spooling device attaches to the drill to form the working element of the drill;
wherein the layout line spooling device forms a spool that takes up the cord for storage.

3. The layout line spooling device according to claim 2
wherein the drill forms a mechanical linkage with the spool structure;
wherein the drill generates a rotational force that is transferred to the spool structure through the mechanical linkage;
wherein the cord is a flexible structure.

4. The layout line spooling device according to claim 3
wherein the handle structure is a rigid structure;
wherein the handle structure forms a grip that is used to carry the layout line spooling device.

5. The layout line spooling device according to claim 4
wherein the mounting bushing is a rolling element bearing;
wherein the mounting bushing mounts on a congruent end of the handle structure;
wherein the mounting bushing attaches to the handle structure such that the axis of rotation of the mounting bushing aligns with the center axis of the handle structure;
wherein the mounting bushing forms a rotating structure;
wherein the mounting bushing secures the spool structure to the handle structure such that the spool structure rotates freely relative to the handle structure.

6. The layout line spooling device according to claim 5
wherein the spool structure is a spool;
wherein the spool structure forms the structure that stores the cord;
wherein the spool structure rotates relative to the handle structure;
wherein the spool structure rotates in a first direction to deploy the cord from the spool structure;
wherein the spool structure rotates in a second direction to retract the cord on to the spool structure;
wherein the second direction is opposite to the first direction.

7. The layout line spooling device according to claim 6
wherein the core shaft structure is a rigid structure;
wherein the core shaft structure is an extension structure;
wherein the core shaft structure forms the reach between the handle flange structure and the distal flange structure.

8. The layout line spooling device according to claim 7
wherein the handle flange structure is a rigid structure;
wherein the handle flange structure forms a stop that prevents the cord from slipping off the lateral face of the core shaft structure;
wherein the handle flange structure attaches to the congruent end of the core shaft structure that is proximal to the handle structure.

9. The layout line spooling device according to claim 8
wherein the distal flange structure;
wherein the distal flange structure is a rigid structure;
wherein the distal flange structure forms a stop that prevents the cord from slipping off the lateral face of the core shaft structure;
wherein the distal flange structure attaches to the congruent end of the core shaft structure that is proximal to the drill.

10. The layout line spooling device according to claim 9
wherein the handle flange structure attaches to the core shaft structure such that the center axis of the handle flange structure is perpendicular to the center axis of the core shaft structure;
wherein the handle flange structure attaches to the core shaft structure such that the center axis of the core shaft structure intersects with the center point of the center axis of the handle flange structure;
wherein the distal flange structure attaches to the core shaft structure such that the center axis of the distal flange structure is perpendicular to the center axis of the core shaft structure;
wherein the distal flange structure attaches to the core shaft structure such that the center axis of the core shaft structure intersects with the center point of the center axis of the distal flange structure.

11. The layout line spooling device according to claim 10
wherein the handle flange structure further comprises a mounting bushing mount;
wherein the mounting bushing mount is a mechanical structure;
wherein the mounting bushing mount mounts on the lateral face of the handle flange structure such that the center of the mounting bushing mount aligns with the center axis of the core shaft structure;
wherein the mounting bushing mount forms the structure of the spool structure that secures the spool structure to the mounting bushing.

12. The layout line spooling device according to claim 11
wherein the distal flange structure further comprises a drill bit;
wherein the drill bit is a bit;
wherein the drill bit forms the mechanical structure that attaches the spool structure to the drill;
wherein the drill bit attaches to the drill such that the rotation of the drill rotates the drill bit;

wherein the drill bit mounts on the lateral face of the distal flange structure such that the axis of rotation of the drill bit aligns with the center axis of the core shaft structure;

wherein the drill bit transfers the rotational force generated by the drill to the balance of the mounting bushing.

* * * * *